United States Patent [19]

Aoyama

[11] 4,278,717

[45] Jul. 14, 1981

[54] HEAT RESISTANT CUSHION

[75] Inventor: Toshiho Aoyama, Nagoya, Japan

[73] Assignee: Chuo Hatsujo Kabushiki Kaisha, Aichi, Japan

[21] Appl. No.: 40,781

[22] Filed: May 21, 1979

[30] Foreign Application Priority Data

May 19, 1978 [JP] Japan ..... 53-60393

[51] Int. Cl.[3] ..... B32B 7/00; B32B 7/04; B32B 15/00

[52] U.S. Cl. ..... 428/36; 422/179; 422/180; 428/253; 428/256; 428/257

[58] Field of Search ..... 428/36, 253, 257, 256; 156/148, 149; 422/179, 180

[56] References Cited

U.S. PATENT DOCUMENTS

| | | | |
|---|---|---|---|
| 2,052,808 | 9/1936 | Spokes | 428/256 |
| 2,882,082 | 4/1959 | Poltorak et al. | 428/256 |
| 2,922,442 | 1/1960 | Webber | 428/257 |
| 3,362,783 | 1/1968 | Leak | 422/180 |
| 3,441,381 | 4/1969 | Keith et al. | 422/180 |
| 3,539,436 | 11/1970 | Hamano | 428/253 |
| 3,692,497 | 9/1972 | Keith et al. | 422/179 |
| 4,005,234 | 1/1977 | Stroupe | 428/36 |

*Primary Examiner*—James J. Bell
*Attorney, Agent, or Firm*—Jordan and Hamburg

[57] ABSTRACT

A heat resistant cushion in the form of a compact of a toroidal structure which is formed by an annular network structure of knitted metal wires, the network structure including a first segment which forms an outer surface of the toroidal structure and a second, inner segment, the second segment containing yarns of an inorganic fiber which are disposed at a given axial separation and extending circumferentially of the network structure and which are support by engagement with selected loops of the metal wires which forms the second segment, the network structure being rolled upon itself beginning with the free end of the second segment.

11 Claims, 8 Drawing Figures

HEAT RESISTANT CUSHION

FIELD OF THE INVENTION

The invention relates to a heat resistant cushion of metallic network, and more particularly, to a resilient support for a catalyst carrier which is used in an exhaust gas purifier associated with an internal combustion engine.

U.S. Pat. No. 3,441,381 discloses an exhaust gas purifier associated with an internal combustion engine which is provided with a monolithic ceramic body having a honeycomb structure which is formed with a coating of catalyst. The principal technical interest in this field is directed to mounting the ceramic body, which is particularly sensitive to mechanical stresses, in a metal casing in a manner to avoid problems whatsoever when the purifier is mounted on an automobile. Under the situation involved, it is appreciated that both the ceramic body and the casing are subject to high temperature loads and rapid temperature changes, whereby their materials are susceptible to different degrees of thermal distortions. To cope with this problem, there has been proposed a heat resistant cushion which is disposed between the ceramic body and the casing. The cushion comprises a compact of a network formed by thin wires of a special steel such as stainless steel or Inconel, and accommodates forces acting radially and/or axially of the ceramic body. This approach has been successful for the first trial.

However, with the recent increasing demand on the high purification efficiency, it is noted that the described approach suffers from a disadvantage that a leakage of unpurified exhaust gas occurs through the tissues of the metal network cushion. Also, there remains a problem that the thin metal wires which form the cushion degrade due to their oxidation inasmuch as they are exposed to hot exhaust gas.

DESCRIPTION OF THE PRIOR ART

Japanese laid-open patent application No. 60,466/1975, which claims the Convention priority based on U.S. Pat. application Ser. No. 401,023 filed Sep. 26, 1973 discloses an annular network formed by thin metal wires in the configuration of the stockings or sleeve and which is then rolled into a toroid. In use, the toroid is compressed into a compact form to be used as a cushion. A possibility is also suggested that fibers of a heat insulating material such as asbestos or rock wool may be used with the network in the cushion. While the application above referred to includes little disclosure as to the manner in which the heat insulating fibers are incorporated into the cushion, it appears that a twisted wire is formed of a metal wire and a yarn of heat insulating fiber before the composite wire is used to form an annular network, which is then rolled into a toroidal form. Alternatively, during the initial phase when the metal network is shaped into a toroidal form, a rope of asbestos is coiled together so that the asbestos forms the core of the toroidal assembly.

An advantage of incorporating heat resistant, inorganic fibers such as asbestos into a cushion formed by a metal network is the fact that the amount of gas passing through the cushion is reduced to a minimum, since almost the entire space within the metal network cushion, having a volumetric proportion of wires (hereafter referred to as wire density) which is as low as 20 to 30% is filled with the inorganic fibers. This alleviates the difficulty that unpurified exhaust gas may leak through the cushion. Because the cushion substantially prevents a passage of the gas therethrough, the exposure to the exhaust gas of the metal wires which are contained in the cushion is reduced, thus retarding the degradation of the cushion due to the oxidation of the metal wires.

However, when a twisted wire comprising a metal wire and asbestos yarn is used to form a metal network cushion containing inorganic fibers, the proportion of asbestos yarn in the volume of the finished cushion (hereafter referred to as inorganic fiber density) increases, with the result that the resilient characteristic of the latter is less than desired. Additionally, those asbestos yarns which are located on the outer surface of the cushion are exposed to high temperatures in use, whereby they become loose from the cushion structure as their material degrades. Where asbestos is used in a bundle form as the core of the toroidal structure, not only a desired resilient characteristic cannot be obtained, but the amount of gas leakage through relatively thick network surrounding the bundle becomes significant.

In a prior attempt to eliminate the described disadvantages of a metal network cushion including inorganic fibers, the inventor formed an annular network including a knitted structure having loops in which regularly spaced courses of loops are formed of asbestos yarns while the remaining courses are formed of metal wires. For example, odd numbered courses are formed by metal wires while even numbered courses are formed by asbestos yarns or vice versa. However, the attempt is found to be commercially unsuccessful because of a breakage in the asbestos yarns which is frequently caused as the yarn is engaged by a loop forming needle on a high speed knitting machine.

SUMMARY OF THE INVENTION

It is an object of the invention to provide a heat resistant cushion having a good sealing effect which supresses the passage of gas therethrough and having a satisfactory resilient response.

It is a specific object of the invention to provide a heat resistant cushion in the form of a compact of a metal network having a predetermined range of wire density and having a controlled amount of inorganic fiber contained therein in admixture.

It is another object of the invention to provide a method of manufacturing the novel metal network cushion described above.

In accordance with the invention, there is provided a heat resistant cushion in the form of a compact of a toroid rolled from an annular network structure which is formed by knitting anti-corrosive metal wires. The network structure comprises a first segment which forms the outer surface of the toroidal form, and a second segment which forms the inner surface thereof. The second segment includes yarns of an inorganic fiber which are disposed to extend circumferentially at a given interval axially of the network structure and which are partly supported be engagement with selected loops of metal wires which form the remainder of the second segment. The network structure may comprise a single annular network having the first and second segments which succeed one after another in the axial direction thereof. Alternatively, it may comprise a first annular network unit which forms the first segment and a second annular network unit which forms the second segment, with the second unit being initially rolled into a toroidal form and surrounded by the first unit which is then rolled therearound. However, in a preferred embodiment, the network structure comprises a pair of concentric annular network units, one end of the inner unit having an axial extension which projects beyond the adjacent end of the outer unit. The outer unit contains yarns of an inorganic fiber, and the extension of the inner unit defines the first segment while the outer unit and a portion of the inner unit which is disposed in overlapping relationship with the outer unit define together the second segment. In this instance, the other end of the outer unit may have an axial extension which projects beyond the other end of the inner unit. Stated differently, the pair of inner and outer units have the same axial length, but are offset in the axial direction while being disposed in concentric relationship.

Each network unit of the annular network structure may be knitted from wires of a stainless steel or special steel such as Inconel, a plain knitting being preferred. The outer surface of a knitted structure represents a front surface and the internal surface a rear surface.

Preferably, asbestos is used for yarns of an inorganic fiber. However, any other heat resistant inorganic fiber may be used such as glass fiber or carbon fiber. A yarn of an inorganic fiber may be engaged with a selected loop or loops in the knitted structure comprising a metal wire, in a conventional manner which is well known in the knitting field. A circular knitting machine which produces a single annular knitted fabric using a plurality of yarns is well known in the art. In the resulting knitted fabric, loops of individual yarns will appear in those courses which are spaced apart by an interval corresponding to the number of yarns used. For example, when two yarns are used to form a knitted fabric, one of the yarns will form loops in an odd numbered course while the other yarn will form loops in an even numbered course. It is then possible to introduce a special yarn which engages only selected loops of a selected course while threading over the remaining loops. The axial separation between the successive runs of the special yarn can be chosen by increasing or decreasing the number of yarns used, thereby enabling the inorganic fiber density to be controlled to a desired value. When a conventional knitting machine is used, the yarn of the inorganic fiber will thread over the inner or rear surface of the annular network comprising metal wires, so that the majority of such yarns will be distributed over the inner surface of the annular network. When yarns of the inorganic fiber are disposed in this manner, these yarns do not form loops, so that a breakage thereof can be prevented if a high speed knitting machine is used for production. A plain knitted fabric exhibits a resistance to bending on the rear surface, but is flexible on its front surface, thereby allowing the annular network to be looped into a toroidal form along its front surface.

Desirable wire density in the finished cushion is discussed in a number of literatures. Generally, the density ranges from 20 to 30%. While not limiting the scope of the invention, the proportion of yarns of the inorganic fiber relative to metal wires may desirably be about 30% by weight.

The heat resistant cushion according to the invention contains yarns of an inorganic fiber which are substantially uniformly distributed throughout. Since these yarns are disposed so as to fill the space between metal wires, the passage of gas therethrough can be reduced to a minimum. The uniform distribution and the controlled amount of yarns of the inorganic fiber prevents any substantial reduction in the resilient response of the cushion as a result of the presence of these yarns. Because of the passage of gas therethrough is substantially inhibited, the degradation of metal wires contained in the cushion due to their oxidation can be effectively prevented. Because the cushion includes a thin, outer covering which comprises intermeshed metal wires, it is possible to prevent, to an effective degree, yarns of the inorganic fiber from becoming loose in use as their material degrades.

DESCRIPTION OF PREFERRED EMBODIMENTS

Figure 1A:
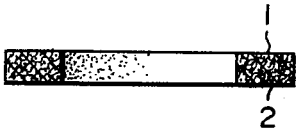
FIGS. 1 (*a*), (*b*) and (*c*) are schematic cross sections illustrating various forms of the heat resistant cushion according to the invention.
Figure 1B:
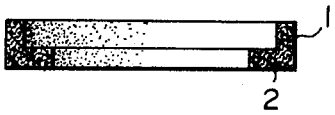
Figure 1C:
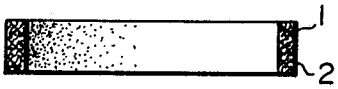

Referring to FIG. 1, there is shown several forms of a heat resistant cushion according to the invention. In FIG. 1 (*a*), the cushion has flat end faces which axially support a catalyst carrier, while the cushion shown in FIG. 1 (*b*) has an inner peripheral surface which is suitable to provide radial support for a catalyst carrier. The cushion of FIG. 1 (*c*) has an L-shaped cross section which both radially and axially supports an end of a catalyst carrier. Any of these heat resistant cushions have an outer surface segment 1 which is covered by intermeshed metal wires while its inner portion 2 comprises a filling formed by a mixture of intermeshed metal wires and yarns of an inorganic fiber. While the finished configuration of the individual cushions are different, they are formed as a compact of a toroidal structure.

Figure 2:
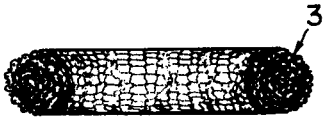
FIG. 2 is a schematic cross section illustrating the toroidal form of the network structure before it is compressed into the cushion shown in FIG. 1.
Figure 3:
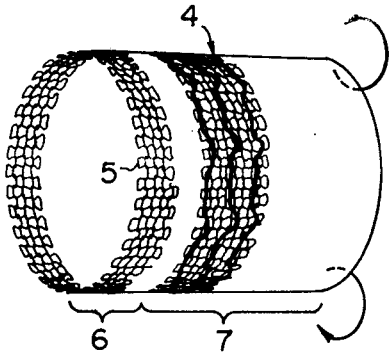
FIG. 3 is a perspective view of an annular metal network structure which is used to form the toroid shown in FIG. 2.
Figure 4:
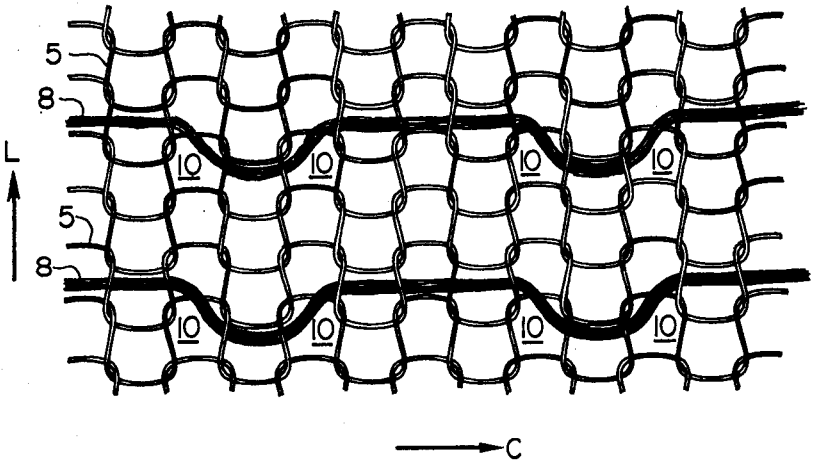
FIG. 4 is a developed, plan view of part of the metal network structure shown in FIG. 3.

FIG. 2 schematically shows a toroidal structure 3, which is formed from an annular metal network structure 4 shown in FIG. 3. The metal network structure 4 represents a single member comprising thin, anti-corrosive metal wires 5 which are knitted into an annular form, and has a pair of axial portions, namely, first portion 6 and second portion 7. As shown in FIG. 4, second portion 7 contains yarns 8 of an inorganic fiber. Yarns 8 engage with only selected loops formed by the metal wires 5 while threading over other loops. As generally viewed, yarns 8 extend circumferentially of the annular metal network structure 4, as indicated by an arrow c shown in FIG. 4, and have a given axial separation therebetween, as indicated by an arrow L shown in FIG. 4. FIG. 4 shows the outside or the front side of the knitted tissue of the annular metal network structure 4. In the example shown, yarns 8 of the inorganic fiber appear every third course such as the first and fourth courses. In each course which is engaged by yarns 8, the latter engages the loop of metal wire 5 in a region indicated by a reference numeral 10, appearing on the front or outer side in such region while it remains free on the rear or inner side. Such a knitted fabric and a knitting machine which produces such fabric are well known in the art, and it will be obvious to one skilled in the art to modify the layout of yarns of the inorganic fiber from that shown in FIG. 4.

The annular metal network structure 4 shown in FIG. 3 is rolled into a toroidal form in a direction indicated by an arrow, beginning from the end of the second portion 7 which contains yarns 8 of the inorganic fiber, thus finally producing the toroidal structure 3 illustrated in FIG. 2. The first portion 6 of the network structure 4 has a sufficient width to surround the outside of the toroidal structure 3. The resulting toroidal structure 3 is compressed in any known manner, resulting in the heat resistant cushion shown in FIG. 1.

Figure 5:
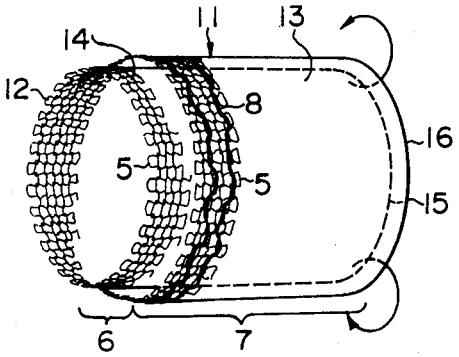
FIG. 5 is a perspective view of another annular metal network structure which is slightly different from that shown in FIG. 3.

FIG. 5 shows another configuration of annular network structure 11 which may be substituted for the structure 4 shown in FIG. 3. As shown, the structure 11 comprises a pair of concentrically disposed annular network units 12, 13. Each unit is knitted into a same diameter using heat resistant metal wires 5 as mentioned previously, but because it has a circumferential flexibility, the both units 12, 13 can be disposed in a concentric manner. The outer unit 13 contains yarns 8 of an inorganic material over its entire axial length which are incorporated into the network in the same manner as mentioned above in connection with FIG. 4. One end of the inner unit 12 has an axial extension 14 which projects beyond a corresponding end of the outer unit 13. It will be noted that the other ends 15, 16 of the both units 12, 13 are aligned with each other. When the both units 12, 13 of the structure 11 are rolled into a toroidal form beginning with the ends 15, 16, the first segment 6 which comprises the extension 14 of the inner unit 12 will form an external layer of the resulting toroidal structure while the second segment 7 which comprises the outer unit 13 and a portion of the inner unit 12 which overlap with the latter will be disposed inside.

Figure 6:
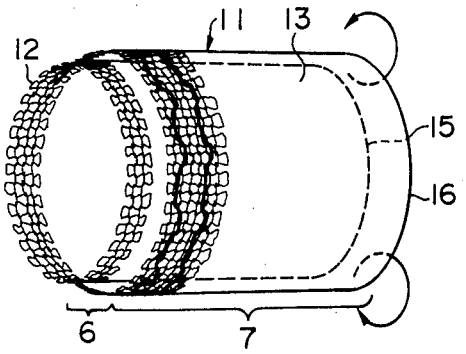
FIG. 6 is a perspective view of a modification of the annular metal network structure shown in FIG. 5.

As shown in FIG. 6, the both inner and outer units 12, 13 may have a same axial length, but may be disposed axially offset from each other while maintaining their concentric relationship. Initially, only the end 16 of the outer unit 13 is rolled into a toroidal form and then rolled together with the inner unit 12. Finally, the inner unit 12 is rolled over the previously formed roll. The resulting toroidal structure has an increased proportion of yarns 8 of an inorganic fiber in the central region thereof.

In a preferred embodiment, a metal wire comprises stainless steel and has a diameter of 0.15 mm while a yarn of an inorganic fiber comprises a specific yarn having more than 99% of asbestos content of high quality and having a thickness which corresponds to a length of 2,500 m per kilogram. Such asbestos yarn corresponds to grade AAAA and a nominal count 0.4 defined by Japan Industrial Standards R 3450—1978. A network formed by knitted metal wires represents a plain knitted fabric having 11 stitches per 25.4 mm in both axial and circumferential directions, and contains asbestos yarns introduced in every third course. The proportion of the asbestos yarns with respect to the metal wires is 30% by weight.

While the invention has been specifically described with reference to several embodiments thereof, it should be understood that these are exemplary only, and not limitative of the invention. A number of modifications and changes will readily occur to one skilled in the art. By way of example, in the network structure shown in FIG. 3, a separate annular network unit which comprises metal wires alone may be disposed concentrically on the inside or outside thereof. Again, in the structures shown in FIGS. 5 and 6, a separate annular network unit comprising metal wires alone may be added to a selected region thereof. The engagement of yarns of an inorganic fiber with only the selected loops of the network formed by knitted metal wires can be achieved in any manner other than that illustrated.

What is claimed is:

1. A heat resistant cushion in the form of a compact of a toroidal structure which is formed by rolling an annular network structure of knitted metal wires into said toroidal structure, the network structure comprising a first annular segment which forms the outer covering of the toroidal structure after said rolling said a second annular segment which forms the inner part of the toroidal structure after said rolling, said second segment containing axially spaced yarns of an inorganic fiber which extend circumferentially of the network structure and which are supported by engagement with selected loops of the metal wires which form said second segment, said first segment comprising regularly knitted, non-yarn bearing metal wire which forms said outer covering whereby said outer covering of non-yarn bearing metal wire protects said yarn on said inner part of said toroidal structure from becoming loose as said yarn degrades during use, said annular network structure being rolled upon itself beginning with the free end of the second segment such that upon completion of the rolling to form the toroidal structure, said first segment is rolled last to form said outer covering of said toroidal structure.

2. A heat resistant cushion according to claim 1, wherein said annular network has an inner side and an outer side, said yarn passing through said loops between said inner and outer sides with each circumferential yarn having a greater portion of the yarn on said inner side, thereby facilitating rolling the annular network structure into said toroidal form.

3. A heat resistant cushion according to claim 1, wherein said annular network is formed of regularly spaced loops and courses of knitted metal wire, said yarn being added to said regularly spaced loops and courses of knitted metal wire of said secod segment.

4. A heat resistant cushion according to claim 1, wherein said loops of metal wire extend in courses circumferentially about the annular network, said yarns of inorganic fiber being disposed circumferentially along courses which are axially spaced from one another by at least one non-yarn bearing course.

5. A heat resistant cushion according to claim 4, wherein said loops of metal wire extend in courses circumferentially about the annular network, said yarns of inorganic fiber being disposed circumferentially along courses which are axially spaced from one another by at least two non-yarn bearing courses.

6. A heat resistant cushion according to claim 1, wherein said annular network comprises a single, generally cylindrical sleeve.

7. A heat resistant cushion according to claim 1, wherein said annular network comprises a pair of concentrically disposed generally cylindrical sleeves, each of said sleeves comprising its own annular network structure of knitted metal wires, said outer sleeve containing said yarns and said inner sleeve being free of yarn, said inner sleeve having one longitudinal end extending beyond one longitudinal end of said outer sleeve to define said first segment.

8. A heat resistant cushion according to claim 7, wherein said inner sleeve is longer than said outer sleeve in an axial direction.

9. A heat resistant cushion according to claim 8, wherein the other end of said inner sleeve is axially aligned with the other end of said outer sleeve.

10. A heat resistant cushion according to claim 7, wherein said inner sleeve is the same length as said outer sleeve in an axial direction.

11. A heat resistant cushion according to claim 10, wherein the other axial end of said inner sleeve is disposed within said outer sleeve.

* * * * *